US007241179B2

(12) United States Patent
Chennakeshu

(10) Patent No.: US 7,241,179 B2
(45) Date of Patent: Jul. 10, 2007

(54) UNIVERSAL AUDIO JACK AND PLUG

(75) Inventor: Sandeep Chennakeshu, Malmo (SE)

(73) Assignee: Sony Ericsson Mobile Communications AB (SE)

( * ) Notice: Subject to any disclaimer, the term of this patent is extended or adjusted under 35 U.S.C. 154(b) by 214 days.

(21) Appl. No.: 10/702,260

(22) Filed: Nov. 5, 2003

(65) Prior Publication Data

US 2004/0175993 A1 Sep. 9, 2004

Related U.S. Application Data

(60) Provisional application No. 60/452,212, filed on Mar. 5, 2003.

(51) Int. Cl.
*H01R 24/04* (2006.01)

(52) U.S. Cl. ..... 439/668

(58) Field of Classification Search ..... 439/668, 439/638, 669, 675, 188
See application file for complete search history.

(56) References Cited

U.S. PATENT DOCUMENTS 5,118,309 A * 6/1992 Ford ..... 439/620
6,069,960 A * 5/2000 Mizukami et al. ..... 381/74
6,394,852 B1 5/2002 Huang
6,461,199 B1 10/2002 Koga et al.
6,718,113 B2 * 4/2004 Mine et al. ..... 385/139
2002/0025728 A1 * 2/2002 D'Addario et al. ..... 439/668
2003/0008564 A1 * 1/2003 Lebron ..... 439/638
2004/0204185 A1 * 10/2004 Snyder et al. ..... 455/574

FOREIGN PATENT DOCUMENTS

EP 1134958 * 9/2001
EP 1202400 5/2002

OTHER PUBLICATIONS

PCT Search Report dated Apr. 5, 2004.

* cited by examiner

*Primary Examiner*—Chandrika Prasad
(74) *Attorney, Agent, or Firm*—Coats & Bennett, PLLC

(57) ABSTRACT

A universal four-contact plug and jack assembly permits interconnection of microphone and stereo audio signals between an audio peripheral incorporating the four-contact plug and an audio device that includes the four-contact jack. Dimensionally, the interconnecting segments of the four-contact plug are, in terms of overall length, consistent with standard three-contact audio plugs which allows the four-contact plug to be plugged into a three-contact jack intended for use with conventional three-contact audio plugs. Similarly, the four-contact jack has three of its contacts positioned as a conventional three-contact jack but with a fourth contact position to interconnect with the additional contact of four-contact plugs. With this configuration, an audio device including the four-contact plug is compatible with audio peripherals including stereo headsets, monaural headsets with microphones, and others.

18 Claims, 6 Drawing Sheets

UNIVERSAL AUDIO JACK AND PLUG

RELATED APPLICATIONS

This application claims priority under 35 U.S.C. § 119(e) from the following U.S. provisional application: Application Ser. No. 60/452,212 filed on Mar. 5, 2003. That application is incorporated in its entirety by reference herein.

BACKGROUND OF THE INVENTION

The field of this invention generally relates to audio connectors, and particularly relates to four-contact jacks and plugs that retain compatibility with standardized three-contact jacks and plugs.

Standardized audio plugs and jacks are frequently used in consumer audio and telecommunication products. Audio plugs are familiar to most people, with the typical audio plug comprising a series of electrically isolated cylindrical segments ending in a "tip" segment. More particularly, the body of the plug usually includes a sleeve, a ring, and a terminating tip. While generally used in audio applications, the sleeve-ring-tip audio plug nomenclature derives from the time when similarly styled plugs were used by operators of the early telephone switchboards. Indeed, such plugs commonly are referred to as "phone" plugs, although they are most commonly used in audio applications. Many manufacturers, such as SWITCHCRAFT, make standardized 2.5 mm and 3.5 mm audio plugs and jacks. Some of the most common uses for audio plugs include termination of headphone/headset cables, microphone cables, guitar cables and other types of audio "patch" cords.

Audio plugs are commonly used for both stereophonic and monaural devices. For example, a stereo headset, such as might be plugged into a WALKMAN or other portable audio device, typically includes an audio-plug terminated cable. In a common electrical configuration for stereophonic peripherals, the left speaker is wired to the plug tip, the right speaker is wired to the plug ring, and the plug sleeve serves as a ground connection. Of course, the audio device includes an audio jack with internal contacts arranged to selectively contact the sleeve, ring, and tip of the inserted plug.

Telephone headsets, as commonly used for telephony applications, do not require stereo sound. Such headsets typically comprise a monaural speaker for audio output and a microphone for audio input. Again, the headset cable is typically terminated by a standardized 3-contact audio plug with, for example, the microphone wired to the plug tip, the speaker wired to the plug ring, and headset ground wired to the sleeve of the plug. Again, the corresponding audio device will include a standardized audio jack that includes the appropriately arranged internal contacts.

Because the sizes and typical wiring schematics for such audio plug and jack combinations are relatively standardized, cross-manufacturer compatibility exists. For example, a headset manufacturer that adopts an industry standard audio plug for its various headset models can be relatively assured that those headsets will be compatible with audio devices from other manufacturers. Thus, there is a significant impetus for manufacturers to use standardized plug and jack configurations.

SUMMARY OF THE INVENTION

The present invention comprises a method and apparatus providing enhanced audio jacks and plugs that offer additional interconnect features while retaining compatibility with existing standardized audio plugs and jacks. In an exemplary embodiment, an audio device includes an enhanced four-contact audio jack that is compatible with audio peripherals that use a corresponding enhanced four-contact audio plug, as well as peripherals using standard three-contact audio plugs. Likewise, an audio peripheral equipped with the enhanced four-contact audio plug is compatible with audio devices using corresponding four-contact audio jacks, and with those using standard three-contact jacks. An exemplary audio peripheral including a four-contact audio plug according to the present invention may, for example, include two speakers providing stereo sound as well as a microphone.

The four-contact plug according to the present invention comprises four ordered segments, including a tip, a first ring, a second ring, and a sleeve. The four-contact plug may be sized consistent with any of the standard sizes for three-contact plugs such that it may be plugged into three-contact jacks as well as four-contact jacks. In an exemplary arrangement, the sleeve and second ring are adjacently positioned and have a combined length that is substantially equal to the length of the sleeve in a similarly sized three-contact audio plug. When used in an audio peripheral with two speakers and a microphone, the tip of the plug electrically connects to the microphone, the first ring electrically connects to a first speaker, the second ring electrically connects to a second speaker, and the sleeve electrically connects to ground. With this configuration, insertion of the plug into a four-contact jack of a compatible audio device couples the device's audio output circuits to the peripheral's speakers, the device's audio input circuit (MIC in) to the microphone, and the appropriate device ground to the peripheral ground. The exemplary physical and electrical configuration of the four-contact plug is compatible with standard three-contact jacks.

The four-contact audio jack according to the present invention includes four separate contacts arranged such that individual jack contacts properly interconnect with corresponding segments of a compatibly sized four-contact audio plug, while retaining compatibility with similarly sized three-contact plugs. Thus, the sleeve and second ring contacts of the four-contact plug are positioned to individually connect with the sleeve and second ring segments, respectively, of a four-contact plug, or together with the sleeve segment of a three-contact plug. Likewise, the first ring contact of the four-contact jack is physically arranged such that it contacts the first ring segment of four-contact plugs and the single ring segment of three-contact plugs. Finally, the tip contact is arranged to properly connect with the tip of both three- and four-contact plugs.

An exemplary circuit arrangement of the audio device that includes the four-contact jack connects first and second audio output circuits, e.g., stereo outputs, with the first and second ring contacts of the jack, connects a microphone input to the tip contact of the jack, and connects a device ground to the sleeve contact of the jack. With this arrangement, the four-contact jack is compatible with audio peripherals that use three-contact plugs, such as stereo headphone peripheral and microphone/speaker headsets.

Many types of electronic devices and peripherals can benefit from the inclusion of the enhanced jacks and plugs of the present invention. For example, a portable communication device, such as a mobile station, can consolidate audio output and microphone input functions into a single enhanced audio jack. Including the enhanced audio jack thus saves valuable space and reduces cost, yet allows the device to retain backward compatibility with audio peripherals that use three-contact plugs. Similar benefits accrue to audio peripherals incorporating the enhanced audio plug, inasmuch as these peripherals work with either audio devices using enhanced audio jacks or standard three-contact audio jacks.

DETAILED DESCRIPTION OF THE INVENTION

Figure 1A:
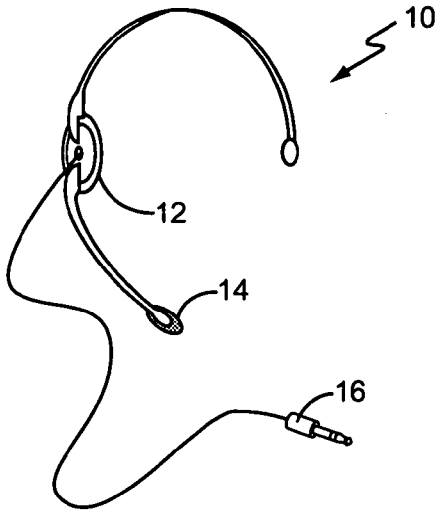
FIG. 1A PRIOR ART
FIGS. 1A-1C illustrate a conventional audio peripheral, its corresponding plug, and corresponding plug-jack schematic illustrations.

Many types of audio peripherals use standardized audio plugs for interconnecting with the respective audio devices. For example, FIG. 1A illustrates an audio peripheral 10 including a speaker 12, a microphone 14, and a standardized three-contact audio plug 16, that, in the illustrated application, provides ground, speaker, and microphone connections with an audio device (not shown). For purposes of this discussion, those skilled in the art will appreciate that the audio plug 16 is typically configured according to any one of the "standard" sizes, such as the 2.5 mm or 3.5 mm industry-standard sizes.

Figure 1B:
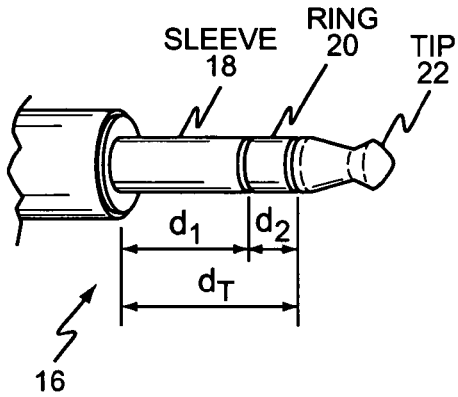
FIG. 1B PRIOR ART

FIG. 1B illustrates audio plug 16 in more detail. Audio plug 16 comprises three electrically isolated segments referred to herein as the sleeve 18, ring 20, and tip 22. For any one of the standard plug sizes, the sleeve 18 has a specified segment length $d_1$, the ring 20 has a specified segment length $d_2$, and the distance from the beginning of the sleeve 20 to the beginning of the tip 22 has a corresponding standard distance $d_T$. Viewed another way, distance $d_T$ represents the combined lengths of sleeve 18 and ring 20. Of course, the tip 22 has corresponding standard dimensions such that overall plug lengths and diameters are consistent across a range of manufacturers.

Figure 1C:
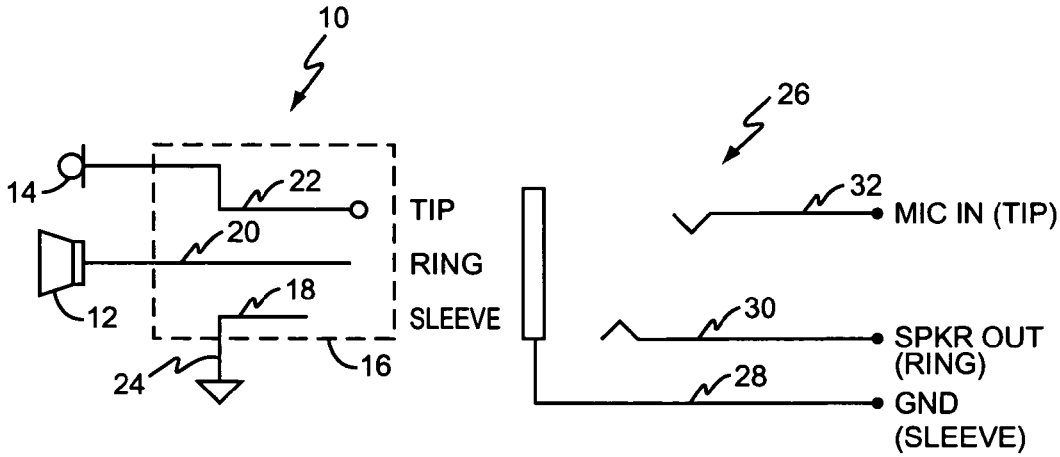
FIG. 1C PRIOR ART

FIG. 1C illustrates exemplary interconnections between the electrically-isolated segments of plug 16 and the audio components of audio peripheral 10. As shown in FIG. 1C, tip 22 electrically connects to the microphone 14, ring 20 electrically connects to the speaker 12, and sleeve 18 electrically connects to a peripheral ground 24. FIG. 1C further provides a schematic representation of a standard three-contact audio jack 26, according to a first audio device configuration. Jack 26 includes a sleeve contact 28, a ring contact 30, and a tip contact 32. For functional compatibility with the wiring of plug 16 as used on audio peripheral 10, the jack's tip contact 32 connects to a microphone input, the ring contact 30 connects to a speaker output, and sleeve contact 28 connects with an appropriate circuit ground.

Figure 2A:
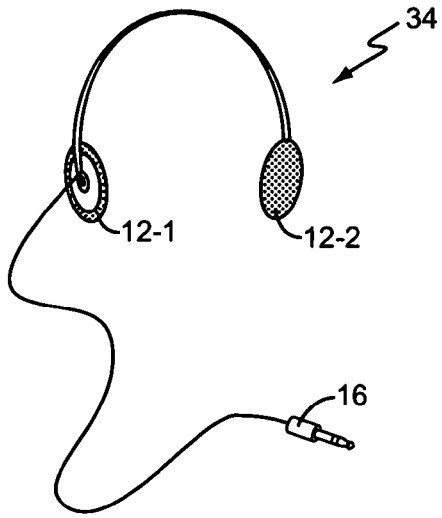
FIG. 2A PRIOR ART
FIGS. 2A-2B illustrate another conventional audio peripheral, its corresponding plug, and corresponding plug-jack schematic illustrations.

FIG. 2A illustrates another audio peripheral 34 that uses audio plug 16 but in a stereo headset configuration. Audio peripheral 34 is a stereo headset that includes two speakers 12-1 and 12-2 providing stereo audio. Thus, plug 16 is wired to two speakers rather than to one speaker and a microphone as was shown for audio peripheral 10.

Figure 2B:
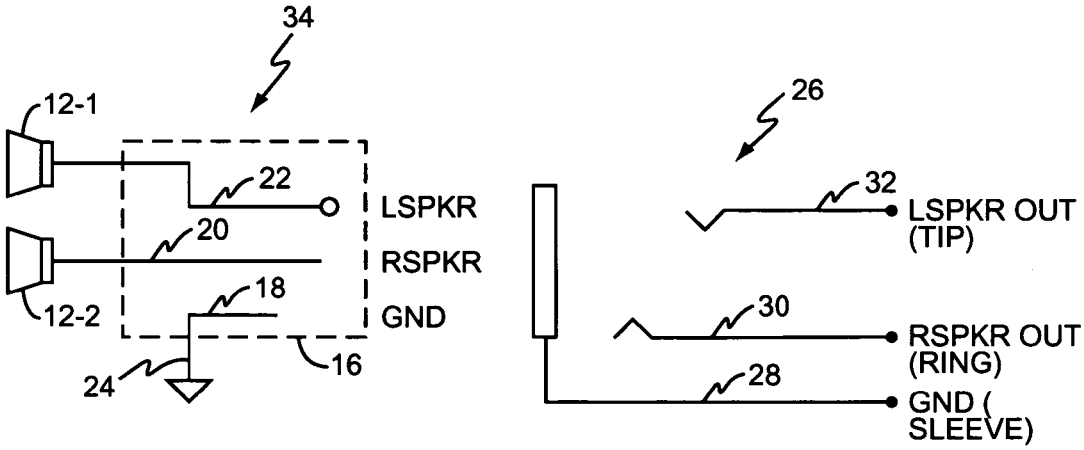
FIG. 2B PRIOR ART

FIG. 2B provides schematic illustrations for peripheral 34, including plug 16, as well as for the standard three-contact jack 26 in a complementary electrical configuration. As shown, speaker 12-1 is connected to tip 22 of plug 16, speaker 12-2 is connected to ring 20 of plug 16, and peripheral ground 24 is connected to sleeve 18 of plug 16. Jack 26 has a compatible configuration. Tip contact 32 of jack 26 connects to a left speaker output, ring contact 30 connects to a right speaker output function, and sleeve contact 28 connects to ground. Thus, insertion of plug 16 into jack 26 interconnects tip 22 with tip contact 32, ring 20 with ring contact 30, and sleeve 18 with sleeve contact 28.

The present invention expands the flexibility of the above three-contact plug-and-jack configurations by adding a fourth segment. Having the extra segment allows, for example, the inclusion of both stereo audio output and microphone input functions in a single plug/jack combination. However, the inclusion of new functionality preferably should not render the new four-contact plug configuration incompatible with standard three-contact jacks, nor render the new four-contact jack configuration incompatible with standard three-contact plugs.

Figure 3A:
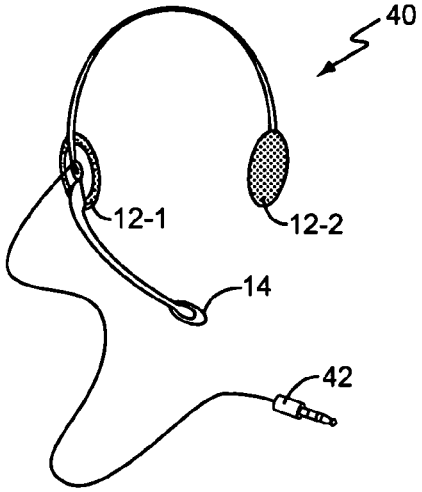
FIGS. 3A-3B illustrate exemplary audio peripherals that include exemplary embodiments of the four-contact enhance audio plug of the present invention.
Figure 3B:
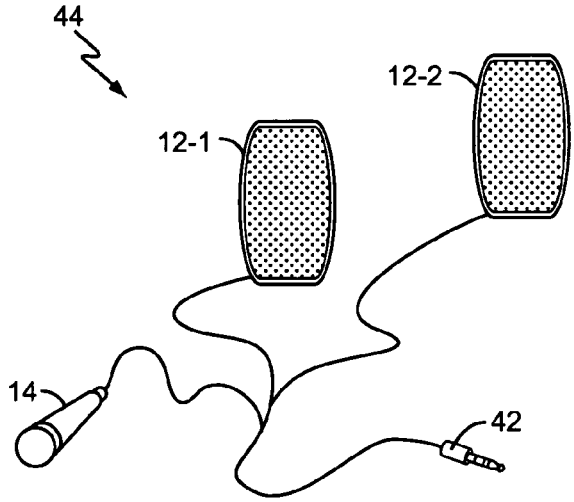

FIG. 3A illustrates an exemplary audio peripheral 40 that, for example, may be used in a "hands-free" telephony application. Audio peripheral 40 includes stereo speakers 12-1 and 12-2, and a microphone 14. Wiring for the speakers 12 and microphone 14 terminates in a four-contact audio plug 42 in this exemplary embodiment. FIG. 3B illustrates a second exemplary audio peripheral 44 that also includes a pair of speakers 12 and microphone 14 that terminate in plug 42, but the physical arrangement of audio peripheral 44 is more suited, for example, for use with computer-based audio applications.

Figure 4:
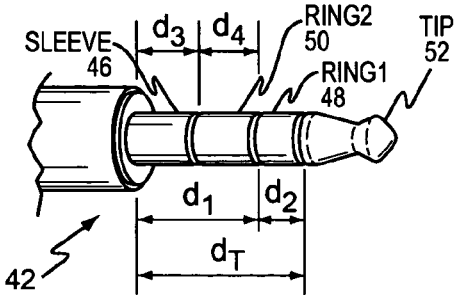
FIG. 4 is a detailed diagram of the four-contact audio plug of the present invention illustrating exemplary dimensioning relative to standard three-contact audio plugs.

FIG. 4 illustrates an exemplary embodiment of the four-contact audio plug 42 in greater detail. Plug 42 comprises four segments including a sleeve 46, first and second rings 48 and 50, respectively, and a tip 52. To retain compatibility with standard three-contact audio jacks, the overall dimensions of plug 42 preferably are consistent with any of the standard audio plug sizes. Moreover, sleeve 46 and the adjacent ring 50 are configured to have a combined segment length $(d_3+d_4)$ substantially equal to segment length $d_1$ of sleeve 18 in a similarly sized three-contact audio plug 16. Similarly, the total length $d_T$ of sleeve 46 and rings 48 and 50 $(d_2+d_3+d_4)$ is configured to have essentially the same total length as the combination of sleeve 18 plus the ring 20 of the three-contact audio plug 16. Likewise, tip 52 of plug 42 is configured to be dimensionally the same or similar to tip 22 of plug 16.

Figure 5:
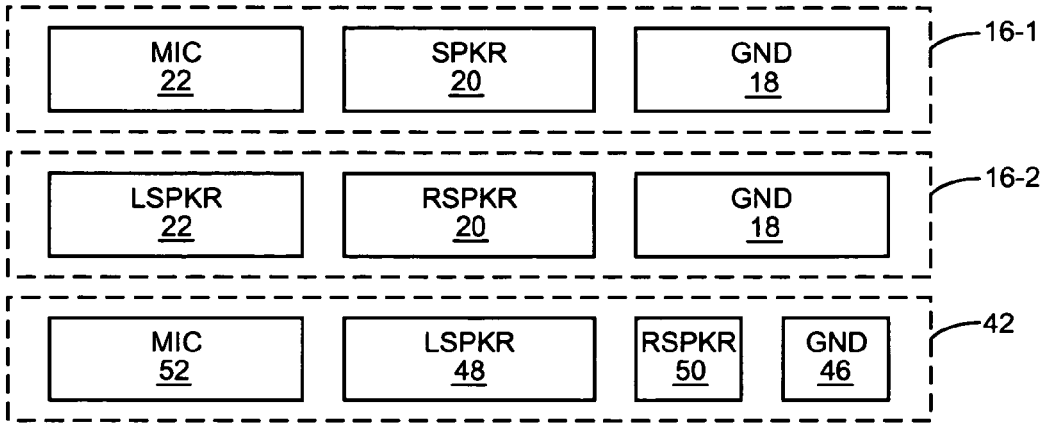
FIG. 5 is a schematic diagram juxtaposing an exemplary arrangement for the inventive four-contact plug with conventional three-contact plug configurations.

The physical configuration described above for plug 42 ensures physical compatibility with the standard three-contact jack 26. Of course, electrical compatibility between plug 42 and jack 26 depends on the electrical configuration of plug 42. FIG. 5 illustrates exemplary wiring details for plug 42 versus established wiring practices for the various configurations of the three-contact audio plugs 16. For example, configuration 16-1 conforms to the wiring used with the earlier-described audio peripheral 10 that included a speaker 12 and microphone 14, while configuration 16-2 conforms to the wiring used with audio peripheral 34 that include stereo speakers 12. Thus, in 16-1, tip 22 is a microphone output connection, ring 20 is a speaker input connection, and sleeve 18 is a ground (return) connection. In 16-2, tip 22 is a first speaker input connection, ring 20 is a second speaker input connection, and sleeve 18 is a ground (return) connection. In comparison, in the exemplary electrical configuration of plug 42, tip 52 connects to microphone 14, ring 48 connects to a first speaker 12-1, ring 50 connects to a second speaker 12-2, and sleeve 46 connects to a peripheral ground connection 54.

With this exemplary electrical configuration, audio plug 42 maintains electrical compatibility with the typical electrical configurations of the three-contact audio jacks 26 shown in FIGS. 1C and 2B. For example, insertion of plug 42 into jack 26 of FIG. 1C results in tip 52 connecting with tip contact 32 (MIC IN), the ring 48 connecting with ring contact 30 (SPEAKER OUT), and the sleeve 46 connecting with sleeve contact 28 (GROUND). The second ring, ring 50, of plug 42 may remain electrically unconnected, but likely will be electrically bridged by sleeve contact 30 of plug 26 such that it is shorted to sleeve 46. However, for audio peripherals 40 or 44, such bridging simply results in the harmless grounding of one of the speakers 12-1 and 12-2. Similarly, insertion of plug 42 into jack 26 of FIG. 2B results in tip 52 connecting with tip contact 32 (SPEAKER OUT), ring 48 connecting with ring contact 30 (SPEAKER OUT), and sleeve 46 connecting with sleeve contact 28 (GROUND). Again, ring 50 may be electrically bridged by sleeve contact 30 of plug 26 such that it is shorted to sleeve 46.

Note that insertion of plug 42 into jack 26 for either of the above jack configurations results in at least one peripheral speaker 12 being connected to a speaker output connection in the jack, thereby providing audio output functionality. Moreover, the other plug-to-jack interconnections are harmless, even if not functionally correct. Therefore, four-contact plug 42 is compatible with standard wiring configurations of the three-contact jack 26.

Figure 6:
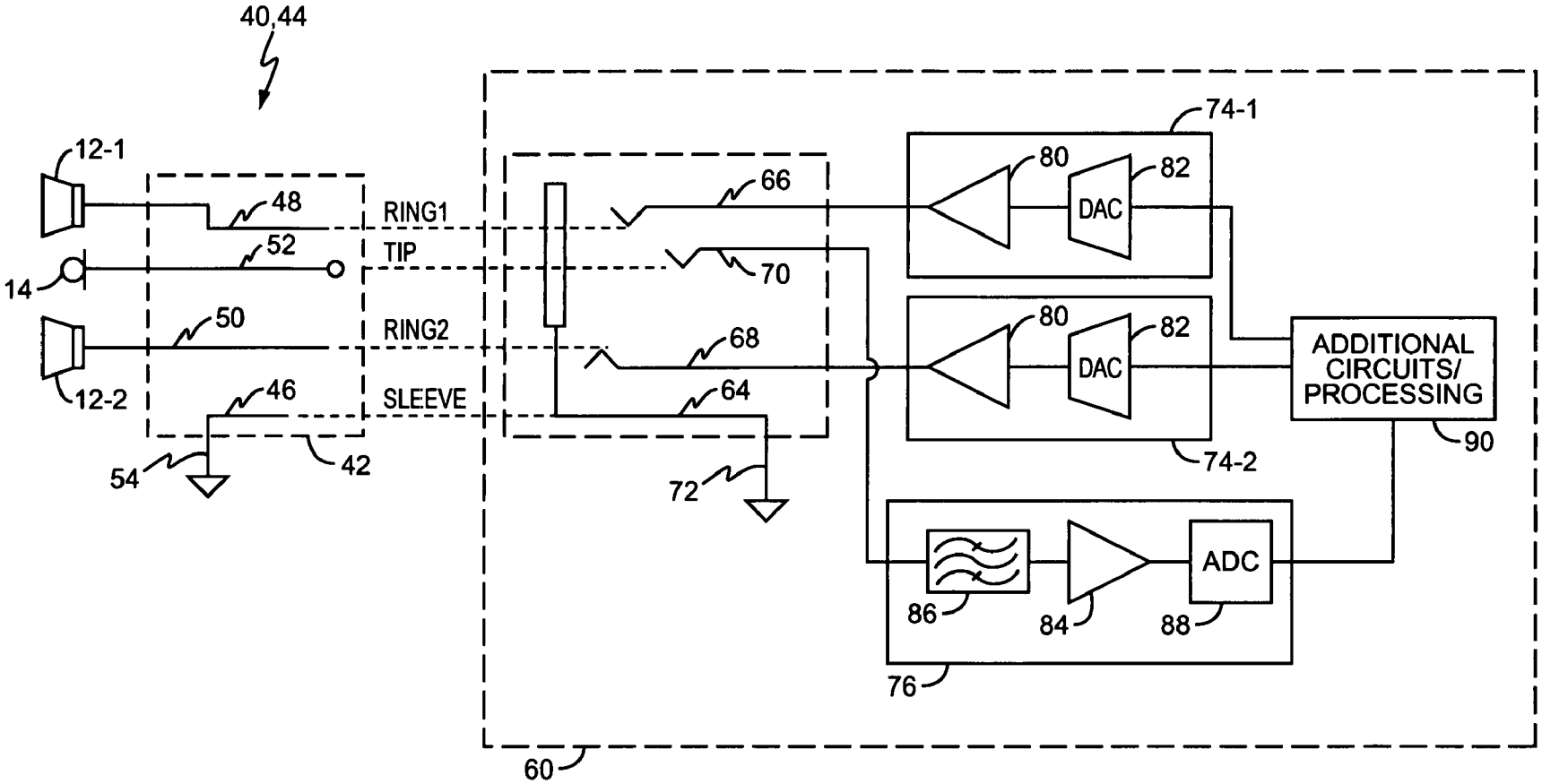
FIG. 6 is a more detailed schematic of exemplary four-contact plug and jack configurations, and illustrates exemplary circuit details for an electronic device incorporating the exemplary four-contact jack.

FIG. 6 illustrates an exemplary audio device 60 incorporating the four-contact audio jack 62 of the present invention for use with audio peripherals that incorporate the exemplary four-contact plug 42, such as peripherals 40 and 44 described earlier. Jack 62 includes sleeve contact 64, first and second ring contacts 66 and 68, and a tip contact 70. In an exemplary configuration of jack 62, sleeve contact 64 is connected to ground connection 72 of audio device 60, ring contact 66 is connected to a first audio output circuit 74-1, ring contact 68 is connected to a second audio output circuit 74-2, and tip contact 70 is connected to an audio input circuit 76. For purposes of discussion, exemplary audio output circuits 74 each comprise an amplifier 80, and a digital-to-analog converter (DAC) 82. The exemplary audio input circuit 76 comprises an amplifier 84 with its input coupled to tip 70 through an input filter 86, and its output coupled to an analog-to-digital converter (ADC) 88.

ADC 88 provides a digitized microphone input signal to one or more additional processing circuits, generically referred to herein as additional circuits 90. Those skilled in the art will appreciate that these additional circuits 90 will vary with the intended use of audio device 60. For example, if audio device 60 is mobile communication device, additional circuits 90 will typically comprise one or more microprocessors, various RF and other communication and input/output circuits. Such details are not necessary to understanding the present invention and will not be further explored. Indeed, inclusion of DACs 82 and the ADC 88 presupposes that the additional circuits 90 process digital audio signals, but this assumption is not germane to the present invention, and it should be understood that such converters may be omitted from device 60 if it operates exclusively in the analog domain.

Regardless of the implementation details of audio device 60, the exemplary electrical configuration of jack 62 is chosen for compatibility with audio plug 42, as well as for backward compatibility with the typical electrical configurations of the standard three-contact audio plugs 16. As such, the audio output signal from audio output circuit 74-1 is coupled to the ring 66 contact of jack 62, and the audio output signal from audio output circuit 74-2 is coupled with the ring contact 68 of jack 62. Lastly, the audio input of audio input circuit 76 is coupled to the tip contact 70 of jack 62.

Figure 7A:
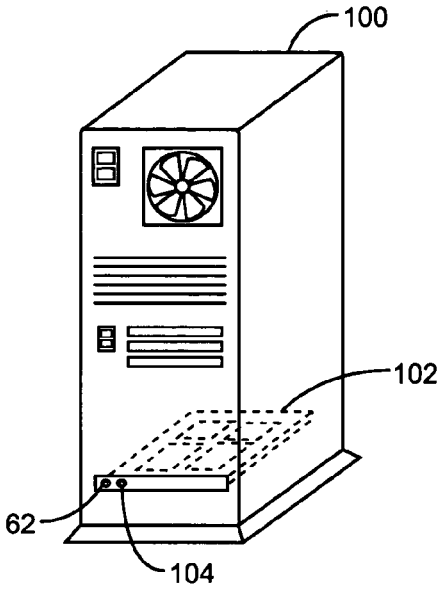
FIGS. 7A-7B and 8A-8B illustrate exemplary applications for exemplary four-contact jacks according to the present invention.
Figure 7B:
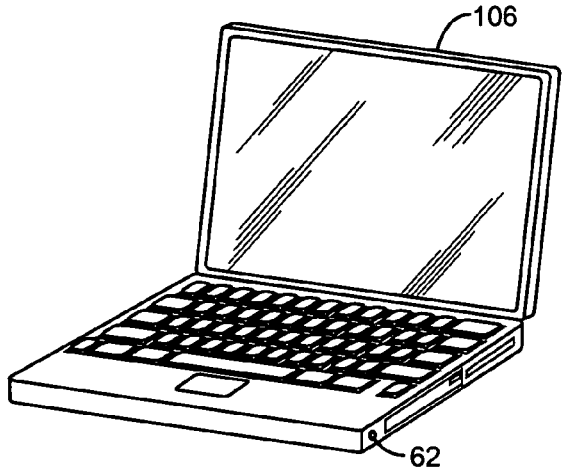

In addition to this electrical arrangement, the various contacts of jack 62 are physically arranged or otherwise positioned to physically contact the corresponding segments of inserted audio plugs 16 and 42 in a desired manner. For compatibility with the three-contact plugs 16, the ring contact 68 is positioned such that both it and sleeve contact 64 connect with sleeve 18 of the three contact plug 16. In other words, ring contact 66 connects with ring 20 of the three-contact plug 16 and with ring 48 of the four-contact plug 42, but ring contact 68 connects with a corresponding ring when plug 42 is inserted, and connects with a sleeve when plug 16 is inserted. Thus, this contact arrangement results in the grounding (sleeve connection) of the output from audio output circuit 74-2 when a three-contact plug 16 is inserted into jack 62. However, such grounding generally is harmless with respect to output circuit 74-2. FIGS. 7A and 7B illustrate exemplary applications of audio jack 62 as used in computer installations. In FIG. 7A, a computer 100 includes a sound card 102, which includes a stereo input jack 104 and the exemplary four-contact audio jack 62. Sound card 102 typically includes audio circuits similar to those depicted in the generic audio device 60 of FIG. 6, thus jack 62 provides combined stereo output with microphone input. Conventionally, sound card 102 would include three jacks, with separate jacks for stereo input, microphone input, and stereo output. However, with the inclusion of jack 62, the stereo output and microphone input functions (or stereo input plus microphone) functions are combined into a single jack. For example, audio peripheral 44 of FIG. 3B may be plugged into jack 62, thereby interconnecting speakers 12-1 and 12-2 with the audio output circuits included on soundcard 102, and the microphone 14 with a microphone input circuit also included on soundcard 102.

Not only does the use of audio jack 62 allow such multiple connections at a single interface point, its use also allows sound card 102 to retain compatibility with older types of audio peripherals using standardized configurations of the three-contact audio plug 16, such as those shown in FIGS. 1A and 2A. In accordance with the exemplary physical arrangement of jack contacts illustrated for jack 62 in FIG. 6, insertion of the standard three-contact plug 16 into jack 62 interconnects the plug's tip 22 with the jack's tip contact 70, the plug's ring 20 with the jack's first ring contact 66, and the plug's sleeve 18 with the jack's sleeve contact 64 and, typically, with the jack's second ring contact 68.

To better understand the backward compatibility of the above four-contact arrangement, compare the wiring arrangement of plug 16 in configuration 16-1 corresponding to audio peripheral 10 (microphone+speaker), and configuration 16-2 corresponding to audio peripheral 34 (stereo speakers), as shown in FIG. 5, with the exemplary schematic of jack 62 shown in FIG. 6. With configuration 16-1 of plug 16, plugging audio peripheral 10 into audio device 60 via jack 62 properly connects microphone 14 of audio peripheral 10 to audio input circuit 76, and speaker 12 to audio output circuit 74-1. As noted earlier, audio output circuit 74-2 may be harmlessly grounded to the sleeve 18 of plug 16.

With configuration 16-2, plugging audio peripheral 34 into audio device 60 via jack 62 connects speaker 12-1 to the audio input circuit 76, which is harmless, and properly connects speaker 12-2 to audio output circuit 74-1 and ground 24 of audio peripheral 34 to ground 72 of audio device 60. Thus, while leaving one of the two speakers 12 in peripheral 34 unpowered, the user is provided with at least one channel of audio output and no harm is done to either peripheral 34 or audio device 60. Further, audio device 60, as described later in more detail, may be configured to distinguish between three- and four-contact audio plugs and modify its audio output in response. For example, if audio device 60 senses insertion of plug 16, it may update the audio signal output from audio output circuit 74-1 so that it changes from a single channel to a combined stereo channel.

Figure 8A:
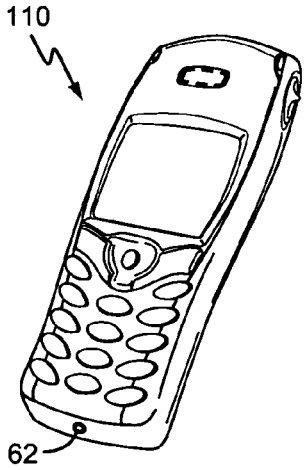
Figure 8B:
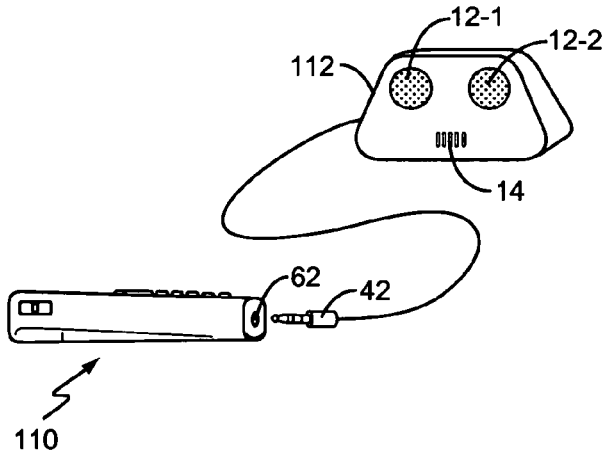

The universal compatibility of jack 62 may be of even greater value in space-constrained applications. FIG. 7B illustrates the use of audio jack 62 in a laptop computer 106. Here, the advantages of combining microphone and output speaker connections within the same jack are more readily apparent, in that peripheral connector space is at a decided premium in the typical laptop design. FIG. 8A illustrates a similarly space-constrained application of audio jack 62, wherein it is included in a mobile station 110, which may be a small cellular telephone or personal digital assistant (PDA) where the elimination of multiple peripheral connectors is of significant value. FIG. 8B illustrates the interconnection between a hands-free communication peripheral 112 that includes speakers 12-1 and 12-2 and microphone 14, and wherein the peripheral 112 interconnects with mobile station 110 based on insertion of audio plug 42 into jack 62. Thus, the exemplary configurations of the four-contact plug 42 and corresponding four-contact jack 62 provide space-critical applications such as mobile telephony with a one-connector solution for hands-free communication peripherals.

As was noted above, insertion of the three-contact audio plug 16, in one or more of its standard wiring configurations, results in grounding of audio output circuit 74-2 of audio device 60, as a consequence of the physical positioning of ring contact 68 within jack 62. That is, the segment length of sleeve 18 in plug 16 is such that ring contact 68 connects with sleeve 18 and, by virtue of sleeve contact 64 of jack 62 also connecting with sleeve 18, ring contact 68 becomes grounded, thereby grounding audio output circuit 74-2. If such grounding is undesirable, audio device 60 may sense grounding and respond appropriately.

Figure 9:
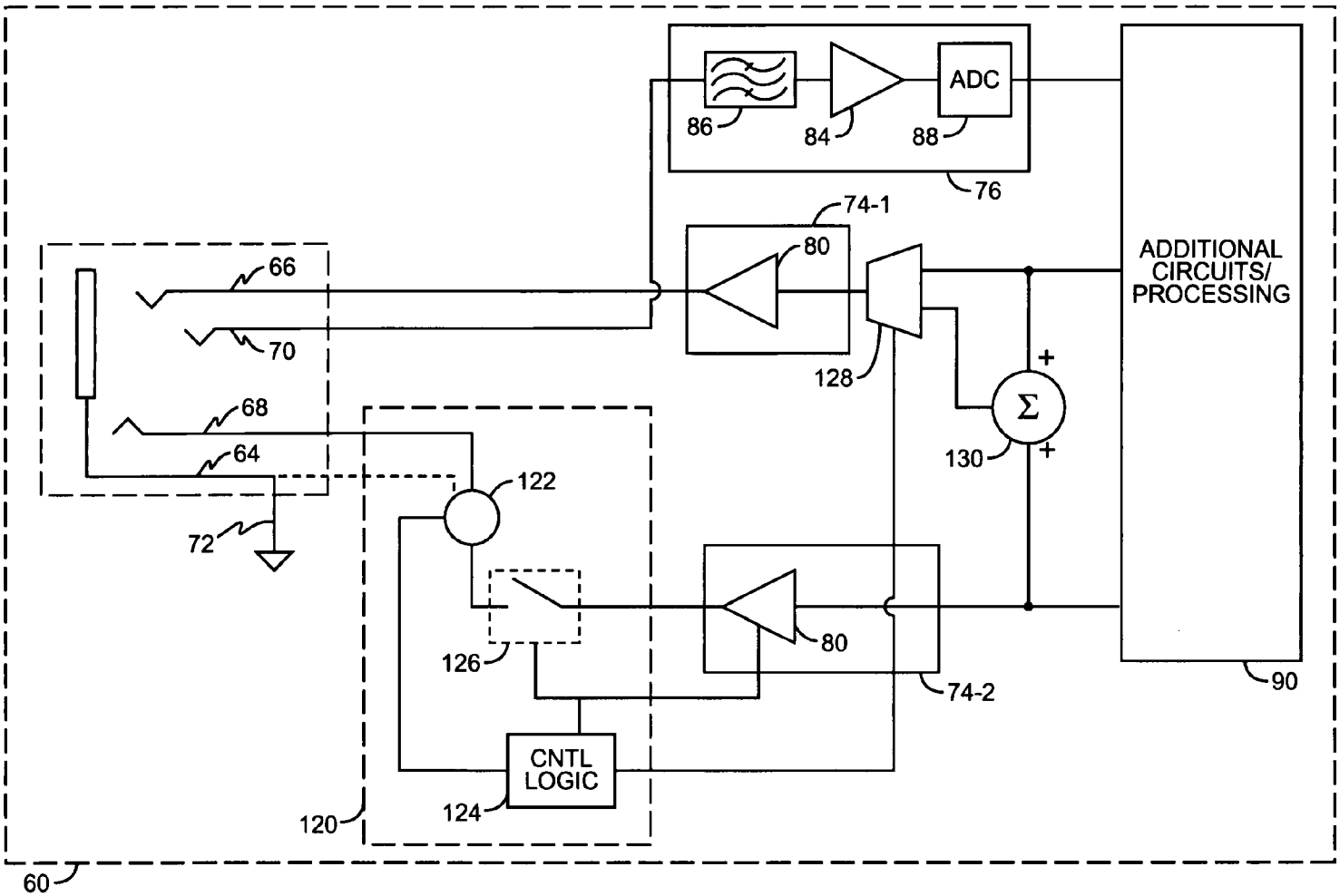
FIG. 9 is a diagram of exemplary circuits for sensing and responding to the insertion of a three-contact audio plug into an exemplary four-contact jack.

FIG. 9 illustrates an exemplary circuit arrangement for sensing and responding to audio circuit grounding. Of course, those skilled in the art will understand that the arrangements shown in FIG. 9 are merely exemplary, and that other circuit arrangements may be employed to similar effect.

In FIG. 9, audio device 60 includes the audio output circuits 74-1 and 74-2 and the audio input circuit 76, as before, but is modified to include a shorting control circuit 120, and, optionally, an audio control circuit comprising circuit elements 128 and 130. Shorting control circuit 120 includes a sensor 122, which may be configured, for example, as a current and/or voltage sensor, and control logic 124 operative to receive an indicator or other signal from sensor 122 indicative of whether ring contact 68 and sleeve contact 64 of jack 62 are shorted together.

If the contacts are shorted together, control logic 124 actuates switch 126, which may be a digitally controlled switch, and which opens the connection between the audio output circuit 74-2 and the ring contact 68. That is, the shorting control circuit 120 may be configured to disconnect audio output circuit 74-2 from jack 62 when ring contact 68 is detected as shorted or otherwise grounded.

Control logic 124 may further operate to shut down or otherwise disable amplifier 80 of the audio circuit 74-2 for power savings while audio circuit 74-2 is disconnected from jack 62. Note that amplifier 80 may be of the type that exhibits a high-impedance output whenever it is disabled. If so, switch 126 may be omitted and amplifier 80 of audio output circuit 74-2 simply placed in high-impedance state responsive to sensing the short between sleeve contact 64 and ring contact 68.

Further, if audio circuit 74-2 is disabled or otherwise disconnected, it may be desirable to adjust the content of the remaining audio signal output by audio output circuit 74-1. Thus, when ring contact 68 of jack 62 is not shorted, audio output circuits 74-1 and 74-2 preferably provide left and right stereo output signals. However, when ring contact 68 is shorted and stereo output is not available, audio device 60 may adjust the audio signal from audio output circuit 74-1 such that it includes combined left and right channel information, or otherwise adjusts it as appropriate for monaural output mode.

Such audio output adjustment may be accomplished in any number of ways, such as by controlling multiplexer 128 such that it outputs one of the stereo channels (either left or right) in a first state, and, in a second state, outputs a summation of the left and right stereo signals as provided by summer 130. Control logic 124 may be used to control the state of multiplexer 128 responsive to sensor 122. Alternatively, additional the circuits 90 may include a signal processor or other signal processing circuitry, that simply reformulates the audio content of the audio signal amplified by audio circuit 74-1 as needed. Such an approach would eliminate the need for multiplexer 128 and summer 130.

In general, the present invention defines exemplary electrical and physical configurations for a four-contact audio plug and jack that provide enhanced interconnect functionality when used as a plug-and-jack pair, but where each maintains backward compatibility with standard three-contact jack and plug configurations. While the above details represent exemplary configurations and applications for the inventive jack and plug configurations, such details are not limiting. Indeed, the present invention is limited only by the scope of the following claims and the reasonable equivalents thereof.

What is claimed is:

1. A jack to interconnect with three- and four-contact audio plugs, said jack comprising:

a first contact arranged to contact a first segment of both three- and four-contact audio plugs;

a second contact arranged to contact a second segment of both three- and four-contact audio plugs;

a third contact arranged to contact a third segment of both three- and four-contact audio plugs; and a fourth contact arranged to contact the third segment of three-contact audio plugs and a fourth segment of four-contact audio plugs; and wherein the jack connects to an audio circuit that includes a microphone input, and stereo audio outputs, and wherein the first contact is coupled to the microphone input, the second contact is coupled to one of the stereo audio outputs, the third contact is coupled to a circuit ground of the audio circuit, and the fourth contact is coupled to the other stereo audio output.

2. The jack of claim 1, wherein the first, second, and third jack contacts are arranged to contact a plug tip, ring, and sleeve, respectively, as said first, second, and third segments of both three- and four-contact plugs.

3. The jack of claim 2, wherein the fourth contact of the jack is arranged to contact a second ring of four-contact audio plugs as said fourth segment, and the sleeve of three-contact audio plugs.

4. The jack of claim 1, wherein the first, second and third segments of three-contact plugs comprise, respectively, a tip segment a ring segment, and a sleeve segment such that the first contact of the jack connects to the tip segment, the second contact connects to the ring segment, and the third contact connects to the sleeve segment.

5. The jack of claim 4, wherein the first, second, third and fourth segments of four-contact plugs comprise, respectively, a tip segment, a first ring segment, a second ring segment, and a sleeve segment such that the first contact of the jack connects to the tip segment, the second contact connects to the first ring segment, the third contact connects to the sleeve segment, and the fourth contact connects to the second ring segment.

6. The jack of claim 1, wherein the first contact connects with a microphone in an audio peripheral coupled to the audio circuit by an audio plug inserted in the jack, the second and fourth contacts connect with speakers in the audio peripheral, and the third contact connects with a ground of the audio peripheral.

7. A plug compatible with three- and four-contact audio jacks, the plug comprising:

a tip segment arranged to contact a tip contact of both three- and four-contact audio jacks;

a first ring segment arranged to contact a ring contact of both three- and four-contact audio jacks;

a second ring segment arranged to contact a second ring contact of four-contact audio jacks; and a sleeve segment arranged to contact a sleeve contact of both three- and four-contact audio jacks; and wherein the plug comprises part of an audio peripheral and is operative to interconnect the audio peripheral with audio devices having either a three-contact audio jack or a four-contact audio jack, and wherein the audio peripheral further comprises a microphone coupled to the tip segment of the plug, a first weaker coupled to the first ring segment of the plug, a second sneaker coupled to the second ring segment of the plug, and a around connection coupled to the sleeve segment of the plug.

8. The plug of claim 7, wherein the first ring segment is immediately adjacent the tip segment, and the second ring segment is disposed between the sleeve segment and the first ring segment.

9. The plug of claim 8, wherein a combined length of the sleeve and second ring segments is substantially identical to a sleeve segment length of a similarly sized three-contact audio plug.

10. The plug of claim 9, wherein segment lengths of the sleeve and second ring segments of the plug are configured such that the second ring segment contacts the sleeve contact of a three-contact audio jack.

11. The plug of claim 10, wherein the sleeve and second ring segments of the plug are arranged such that upon insertion of the plug into a three-contact lack, the sleeve contact of the jack bridges the sleeve and second ring segments of the plug.

12. The plug of claim 7, wherein overall dimensions of the plug are substantially identical to overall dimensions of a standardized 2.5 mm audio plug, such that the plug is compatible with 2.5 mm audio jacks.

13. The plug of claim 7, wherein overall dimensions of the plug are substantially identical to overall dimensions of a standardized 3.5 mm audio plug, such that the plug is compatible with 3.5 mm audio jacks.

14. An audio device comprising:

an audio input circuit;

first and second audio output circuits; and a four-contact audio jack compatible with three- and four-contact audio plugs, said jack connected to the audio input and output circuits and comprising:

a first contact arranged to contact a tip segment of both three- and four-contact audio plugs;

a second contact arranged to contact a ring segment of both three- and four-contact audio plugs;

a third contact arranged to contact a sleeve segment of both three- and four-contact audio plugs; and a fourth contact arranged to contact a second ring segment of four-contact audio plugs and the sleeve segment of three-contact audio plugs; and wherein the first contact is coupled to the audio input circuit, the second and fourth contacts are coupled to the first and second audio output circuits, respectively, and the third contact is coupled to a around of the audio device.

15. The audio device of claim 14, wherein the audio device further includes shorting detection and control circuits operative to disable the second audio output circuit responsive to detecting a short between the third and fourth contacts of the jack.

16. The audio device of claim 14, wherein the audio device further includes shorting detection and control circuits operative to disable one of the first and second audio output circuits if the corresponding contact for the audio output circuit in the jack is grounded.

17. The audio device of claim 16, wherein the audio device further includes an audio output control circuit that adjusts an audio signal output by the audio output circuit that is not disabled based if the other audio output circuit is disabled.

18. The audio device of claim 17, wherein the audio output control circuit adjusts the the audio signal to be a combined stereo audio signal if the other audio output circuit is disabled, and adjusts the audio signal to be one channel of a stereo audio signal if the other audio output circuit is not disabled.

* * * * *